US006148486A

United States Patent [19]

Uehara et al.

[11] Patent Number: 6,148,486

[45] Date of Patent: Nov. 21, 2000

[54] BELT MOUNTING STRUCTURE OF SYNTHETIC RESIN BUCKLE

[76] Inventors: Ryoichiro Uehara, 4018, Mikkaichi, Kurobe-shi, Toyama-ken; Yoshinobu Takahashi, 1309, Sanga, Uozu-shi, Toyama-ken, both of Japan

[21] Appl. No.: 09/217,905

[22] Filed: Dec. 22, 1998

[30] Foreign Application Priority Data

Dec. 24, 1997 [JP] Japan ..... 9-354404

[51] Int. Cl.[7] ..... A44B 11/25

[52] U.S. Cl. ..... 24/170; 24/194; 24/614; 24/615

[58] Field of Search ..... 24/170, 614, 615, 24/194

[56] References Cited

U.S. PATENT DOCUMENTS

| | | | |
|---|---|---|---|
| Re. 12,086 | 2/1903 | Sourek | 24/170 |
| 1,363,731 | 12/1920 | Hayden | 24/170 |
| 4,457,052 | 7/1984 | Hauber . | |
| 4,608,735 | 9/1986 | Kasai | 24/194 |
| 4,800,629 | 1/1989 | Ikeda . | |
| 5,243,741 | 9/1993 | Fudaki et al. | 24/200 |
| 5,438,737 | 8/1995 | Anscher et al. | 24/615 |
| 5,465,472 | 11/1995 | Matoba | 24/625 |
| 5,651,166 | 7/1997 | Lundstedt . | |

FOREIGN PATENT DOCUMENTS

| | | |
|---|---|---|
| 2 556 421 | 6/1985 | France . |
| 2 295 198 | 5/1996 | United Kingdom . |

*Primary Examiner*—Victor N. Sakran

[57] ABSTRACT

A belt mounting structure in a buckle which can securely fix a belt in use and allows easy adjustment of an effective belt length and removal of the belt. A belt winding rod freely reciprocates in a direction of fastening the belt and freely rotates at a predetermined angular range within a belt mounting hole. A bulging portion is formed along an upper end edge of the belt mounting hole in the side to which the buckle is connected. A cross-section of a main body of the belt winding rod is formed substantially in a waterdrop shape. A cross-section of each supporting axial portion of the belt winding rod is formed substantially in a shape of an isosceles triangle. When an oblique side portion of the axial portion is mounted and supported on a long side portion of a supporting hole, a tip portion of the main body is pressure contacted to a lower surface of the bulging portion via the belt. When the axial portions rotate to the side of an upper surface of the buckle within the supporting holes, the tip portion of the main body can rotate in the same direction over the bulging portion with the belt while avoiding an interference with the bulging portion.

10 Claims, 8 Drawing Sheets

BELT MOUNTING STRUCTURE OF SYNTHETIC RESIN BUCKLE

BACKGROUND OF THE INVENTION

1. Field of the Invention

The present invention relates to a buckle applied to various kinds of fastening belts such as a suspending belt for bags, a human body restraining belt and the like, and more particularly to a buckle having a feature in a mounting portion of the belt.

2. Description of the Related Art

Conventionally, a buckle connecting between belts and an effective belt length can be adjusted is constituted by a plug and a socket as disclosed in, for example, Japanese Patent Laid-Open Publication No. 63-160605 and Japanese Utility Model Laid-Open Publication No. 7-24105, and is structured such that engaging portions are formed at tip end portions of a pair of insertion leg portions linearly projecting from a base portion of the plug and engaged portions with which the engaging portions are to be engaged are provided in the socket. Further, both side surfaces of the pair of the insertion leg portions have operating portions for canceling engagements of the engaging portions engaged with the engaged portions within the socket, and have opening portions through which the operating portions expose in an engaging state of the plug and the socket.

An operation of the buckle is performed by inserting the plug in the socket from an insertion port thereof and engaging the engaging portions of the insertion leg portions with the engaged portions within the socket while elastically deforming. At this time, the pair of insertion leg portions abut against the engaged portions within the socket at the side surfaces according to the inserting operation, and the insertion leg portions are elastically deformed inwardly toward each other and return, so that the engaging portion and the engaged portions are engaged with each other. Further, when the buckle is released, the engagement is released by pushing the operation portions of the plug exposed from the opening portions of the socket inwardly so as to elastically deform the insertion leg portions, so that the plug is pulled out from the socket.

On the other hand, in addition to the buckle provided in end portions of a pair of belts, as disclosed in U.S. Pat. No. 4,457,052 and Japanese Patent Laid-Open Publication No. 8-140712, for example, there is a buckle constituted by two sets of plugs and a socket to which the two sets of plugs are inserted so as to be engaged therewith, in which each of the plugs has an insertion portion projecting from a base portion thereof and the socket has a pair of portions to be engaged with and released from the respective engaging portions of the insertion portion. For example, in accordance with the buckle disclosed in Japanese Patent Laid-Open Publication No. 8-140712, the insertion portion is constituted by a plate body having engaging hooks at its tip end, a base end of each engaged portion is supported at an end of an insertion port on a back surface side of the socket, an end thereof is bent so as to be formed as a push button exposing from a central opening portion at a front surface side of the socket and capable of being elastically deformed, and hooks which are engaged with the engaging hooks of the plug are provided. When releasing the engaging hooks in an engaged state from the engaged hook, they can be easily released by pressing the push button exposing to the surface of the buckle.

Here, in the buckle mentioned above, with respect to the belt mounting portion in the plug in which the effective length of the belt can be adjusted, the belt mounting portion in each of the plugs disclosed in the Japanese Patent Laid-Open Publication No. 8-140712, for example, extends in an inclined manner toward a back surface side of the socket with respect to an outwardly extending direction of the belt. Then, a rectangular belt mounting hole to which a tip end portion of the belt is inserted and a turn-up rod provided in the belt mounting hole so as to reciprocate in the belt extending direction within a predetermined range and rotate around axial portions at both ends within a predetermined angular range are provided in each of the belt mounting portions.

The turn-up rod is structured such that the axial portions at the both ends are loosely fitted to elongated holes formed through walls on right and left side of the mounting hole. The axial portions at the both ends of the turn-up rod have a width at which they can reciprocate in a belt extending direction within the elongated hole at a predetermined distance, and is formed in an oval cross section with which they can rotate at a predetermined angle. Further, uneven portions eating into the belt are projected from edge portions of front and rear ends in the belt extending direction of the mounting hole so as to be opposed to the turn-up rod. The same uneven portions are formed on end surfaces of the turn-up rod mutually opposing to the former uneven portions. Further, a cross-sectional configuration of a main body of the turn-up rod is formed in a diamond shape having two lines parallel to a direction of a long diameter of the axial portion, and is structured such that when the main body of the turn-up rod rotates within the mounting hole, acute angle portions are brought into contact with front and rear inner wall surfaces of the mounting hole in the belt extending direction with the belt held therebetween.

When pulling the belt inserted to the mounting hole and wound around the turn-up rod in a longitudinal direction of the buckle, the main body of the turn-up rod moves in the belt extending direction within the elongated hole. At this time, a rotation moment acts on the turn-up rod, the acute angle portions strongly press the inner wall surface of the mounting hole by nipping the belt, and the uneven portions of the both elements press the belt therebetween in the front and rear portions so as to securely hold the belt.

Accordingly, in order to take out the belt or adjust an effective length of the belt, when pulling the belt to a direction of the back surface side of the belt mounting portion rather than the extending direction thereof, the turn-up rod rotates in a direction of moving apart from the uneven portions around the axial portion and gaps between the uneven portions in the mounting-hole and those of the turn-up rod are increased, so that the belt is easily moved and the belt can be taken out or the effective length thereof can be adjusted. However, since the turn-up rod has narrow gaps between the turn-up rod and the inner wall surfaces of the mounting hole, a frictional force is easily generated between the turn-up rod and the belt, between two belts and between the belt and the inner walls, respectively, as usual, although the frictional force is different in accordance with a material and a structure of the belt. Accordingly, when taking out the belt or adjusting the effective length of the belt, the turn-up portion of the belt can not easily move, so that an operability is far from excellent. Further, there is a case that the turn-up rod accidentally rotates when using the buckle, and there is a problem that the belt is loosened and moved at this time, so that the belt can not be maintained at a predetermined adjusted length.

SUMMARY OF THE INVENTION

An object of the present invention is to provide a belt mounting structure in a buckle which can surely fix a belt when being used in a state that the belt is connected and can smoothly move the belt when taking out the belt and adjusting an effective length of the belt.

The object mentioned above can be achieved by the inventions in accordance with claims the following aspects of the present invention.

In accordance with one aspect of the invention, there is provided a belt mounting structure of a synthetic resin buckle including a plug, a socket and belt mounting portions provided in respective base portions of the plug and the socket. In the structure, at least one of the belt mounting portions has a belt winding rod which can reciprocate in a direction of fastening the belt within a belt mounting hole and can rotate at a predetermined angular range, holes for supporting axial portions of the belt winding rod in the form of elongated holes are formed on right and left side wall surfaces, which are perpendicular to the belt fastening direction, of the belt mounting hole, and a main body and the both end axial portions provided in the belt winding rod, the both end axial portions being loosely supported in the supporting holes. The structure is characterized in that a bulging portion is formed along an upper end edge of the belt mounting hole in the side to which the buckle is connected, a cross-sectional configuration of the main body is formed substantially in a waterdrop, and a cross section of the axial portion is formed substantially in a shape of an isosceles triangle, and each axial portion is provided on the main body in accordance with a positional relation such that when an oblique side portion of the axial portion is mounted and supported on a long side portion of the supporting hole in a closely attached state, a tip portion of the main body is pressure contacted to a lower surface of the bulging portion via the belt, and when the axial portion relatively rotates to the side of the upper surface of the buckle within the supporting hole, the tip portion of the main body can rotate in the same direction over the bulging portion through the belt with avoiding an interference with the bulging portion.

When the belt is pulled rearward substantially in parallel to a lower surface of a connection rod formed at the rear end of the plug, a rotational force in a counterclockwise direction acts on the belt winding rod, so that an oblique surface of each axial portion in the belt winding rod is in a state of being closely attached to the axial portion supporting hole.

Since the axial portion of the belt winding rod and the main body of the belt winding rod are integrally formed in accordance with the relation mentioned above, the tip portion of the main body of the belt winding rod is in contact with the lower surface of the bulging portion expanding from the upper end edge of the front wall surface in the belt mounting hole via the belt so as to pressure contact the same surface when an oblique surface of the axial portion is in a state of being closely attached to the axial portion supporting hole. Accordingly, the belt wound around the belt winding rod and tensioned in a direction substantially in parallel to a connecting direction of the buckle is held between the belt mounting hole and the belt winding rod, so that the belt is not loosened.

When it is intended to take out the belt from the plug or adjust an effective length thereof, the belt mounting hole and the belt winding rod are relatively rotated by inserting a finger under a lower surface of the connection rod disposed in a side opposite to the extending direction of the insertion leg portion of the plug and lifting up the rearward extending portion of the connection rod, and when pulling down the belt, the tip portion of the main body passes through the bulging portion without interfering with the bulging portion of the belt mounting hole so as to be rotated to the upper surface side of the buckle. Due to this rotation, the nipping by the belt mounting hole and the belt winding rod is canceled, a gap between them is increased, and a friction force exerting on the belt wound around the belt winding rod is reduced, so that it is possible to freely move the belt on the belt winding rod.

In accordance with a second aspect of the invention, in addition to the structure mentioned above, an uneven surface for eating into the belt is formed along an upper end edge of the connection rod in the side opposite to the buckle connection portion, and an uneven surface is formed at least in the tip portion of the main body of the belt winding rod. As a result, the uneven surfaces strongly eat into the belt, and further, the uneven surface formed in a shoulder portion of the connection rod and the uneven surface formed at a lower end of a downward projection portion in the connection rod strongly eat into the end portion of the belt wound around the main body of the belt winding rod and pulled outward from a rear belt insertion space to a rearward direction between the main body of the belt winding rod and the connection rod, so that the belt can be more surely prevented from moving.

In accordance with a third aspect of the invention, the connection rod of the belt mounting portion on the end portion opposite to the buckle connection portion is formed in a substantially inverted-L-shaped cross-sectional configuration or thinner than a thickness of the belt mounting portion. Accordingly, since a space to which the finger can be inserted is formed between the belt and the rear end of the belt mounting portion when it is intended to take out the belt or adjust an effective length of the belt, the gap between the belt winding rod and the belt mounting hole can be wider as mentioned above by inserting the finger to the space and lifting up to the upper side of the buckle, thus, it is possible to move the belt more freely.

In accordance with fourth and fifth aspects of the present invention, it is defined that the belt mounting hole is provided in the belt mounting portion of the plug or the belt mounting portion of the socket. Further, with respect to a type of the buckle, according to sixth and seventh aspects of the present invention, the invention can be applied to a buckle comprising a combination of single socket and single plug, a buckle comprising a combination of single socket and two plugs or any other types of buckles.

DESCRIPTION OF THE PREFERRED EMBODIMENTS

Figure 1:
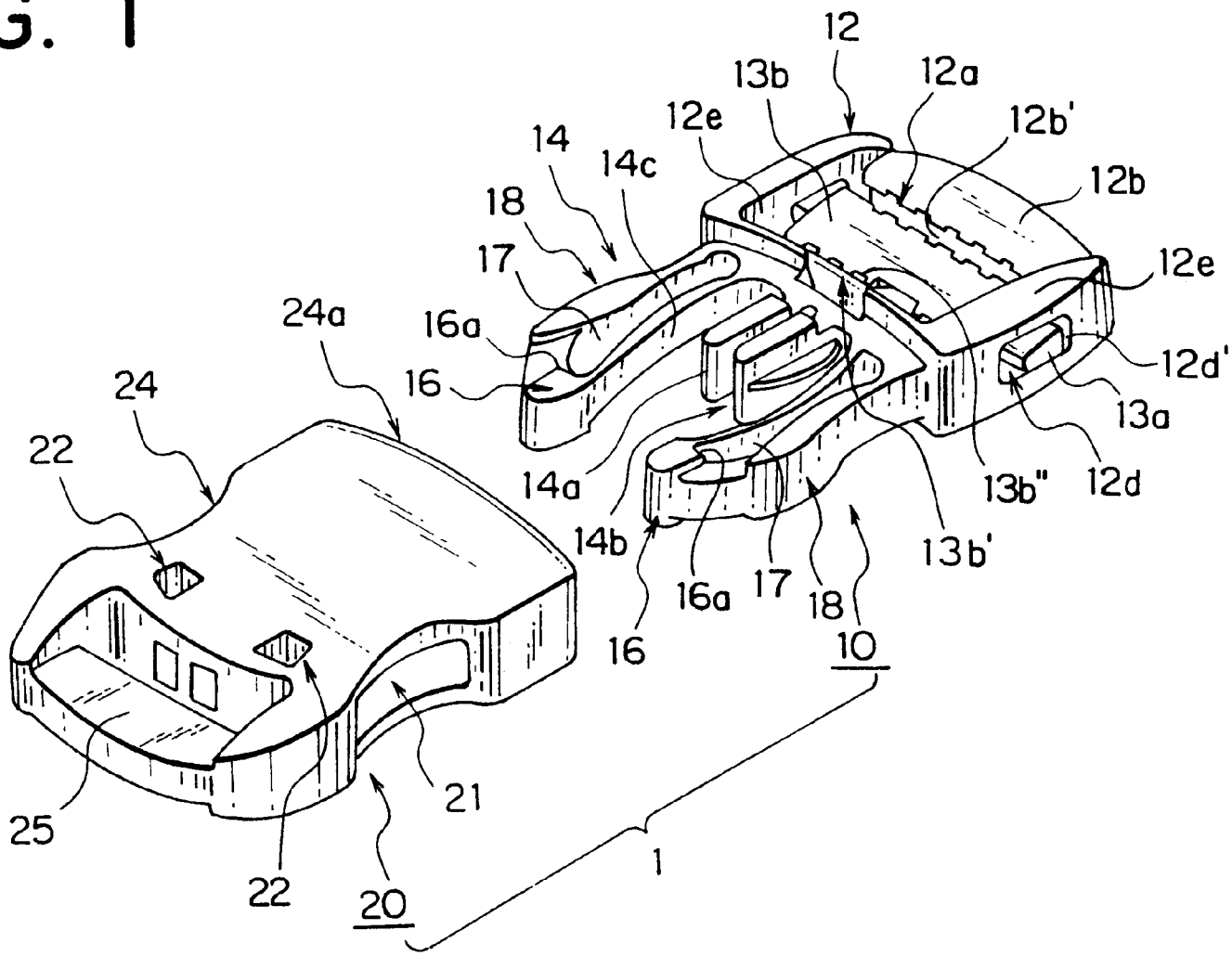
FIG. 1 a perspective view which shows a separation state of a buckle comprising a socket and a plug provided with a belt mounting structure in accordance with a first embodiment of the present invention.

Preferred embodiments in accordance with the present invention will be in detail described below with reference to the accompanying drawings.

FIGS. 1 to 5 show a first embodiment in which a belt mounting structure in a buckle in accordance with the present invention is applied to a plug.

In accordance with this embodiment, a buckle 1 is constituted by a synthetic resin plug 10 mounted to an end of a belt 2 and a synthetic resin socket 20 mounted to another end of the belt 2 or an end of another belt (not shown). A pair of insertion leg portions 14 projecting from a belt mounting portion 12 and formed in a laterally symmetrical manner are provided in the plug 10. An engaging portion 16 having an engaging surface 16*a* inclined slightly inward from a perpendicular direction with respect to the projecting direction of the insertion leg portion 14 is provided on each of front and back surfaces. The pair of insertion leg portions 14 are formed in a totally curved manner so as to expand outwardly, and an elongated hole 17 extending from the mounting portion 12 to a tip end portion in a direction perpendicular to a plane including a pair of insertion leg portions 14 is formed in each of the insertion leg portions 14. Further, an operation portion 18 is formed in a side surfaces outside each of the insertion leg portions 14, and an end edge portion of the operation portion 18 at the mounting portion 12 side is formed in a step shape.

A recess groove 11 is formed between the operation portion 18 and the first engaging portion 16 in the tip end portion of the insertion leg portion 14. A protruding piece 14*a* protruding in the same direction as that of the insertion leg portions 14 is formed in the middle of the pair of right and left insertion leg portions 14, and a groove portion 14*b* is formed from the middle of the protruding piece 14*a* to the tip end thereof.

Further, the belt mounting portion 12 mentioned above is provided with a specific structure of the present invention for inserting and fixing an end portion of the belt or the like, and has a rectangular belt mounting hole 12*a* and a belt winding rod 13 for separating the belt mounting hole 12*a* into two portions in an extending direction of the insertion leg portion 14 (hereinafter, referred as a longitudinal direction).

As shown in FIGS. 1 to 5, the belt mounting hole 12*a* is formed substantially in a rectangular shape, and an uneven surface 12*b*' for eating into the belt 2 is formed on an inner surface of an upper end edge of a connection rod 12*b* disposed in the side opposite to the extending side of the insertion leg portion 14. A cross section of the connection rod 12*b* is formed substantially in an inverted-L shape, and the uneven surface 12*b*' is formed in a pent roof portion slightly projecting to an extending side of the insertion leg portion 14 from a shoulder portion of the L-shaped cross section. Further, another uneven portion 12*b*" is also formed in the protruding portion in the lower surface side of the connection rod 12*b* in the same manner. The wall surface in the extending side of the insertion leg portion 14 of the belt mounting hole 12*a* has an expanding portion 12*c* along the upper end edge thereof. Further, a horizontally elongated axial portion supporting hole 12*d* is formed through substantially a center of each of right and left side wall portions 12*e* of the belt mounting hole 12*a*.

Figure 4:
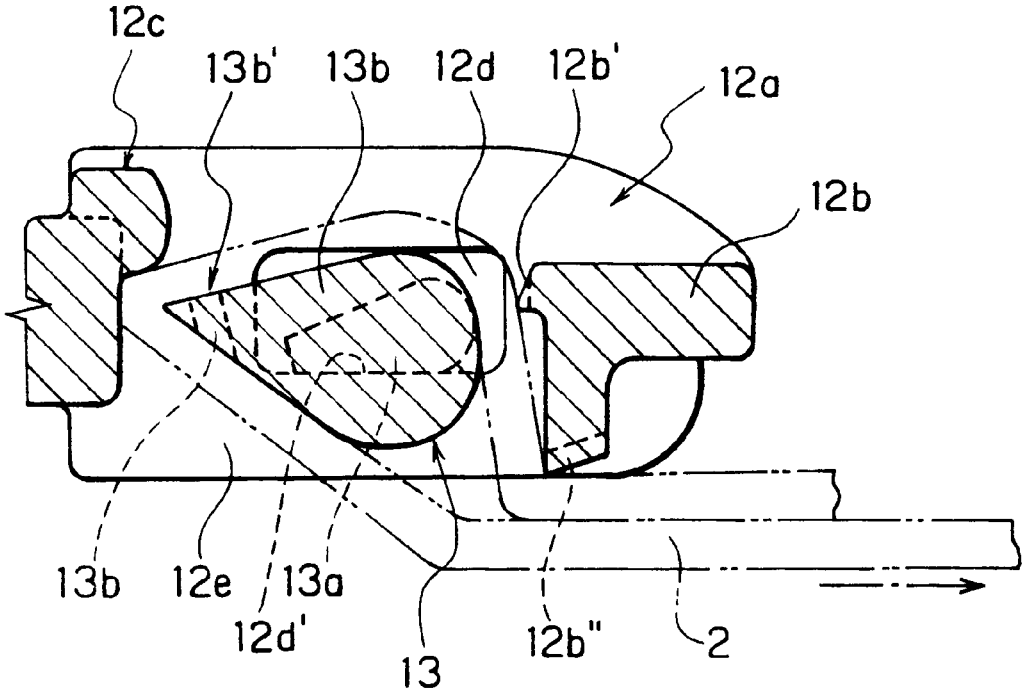
FIG. 4 is a cross sectional view which shows a function at a time of fixing the belt by the belt mounting structure in the buckle of FIG. 1.
Figure 5:
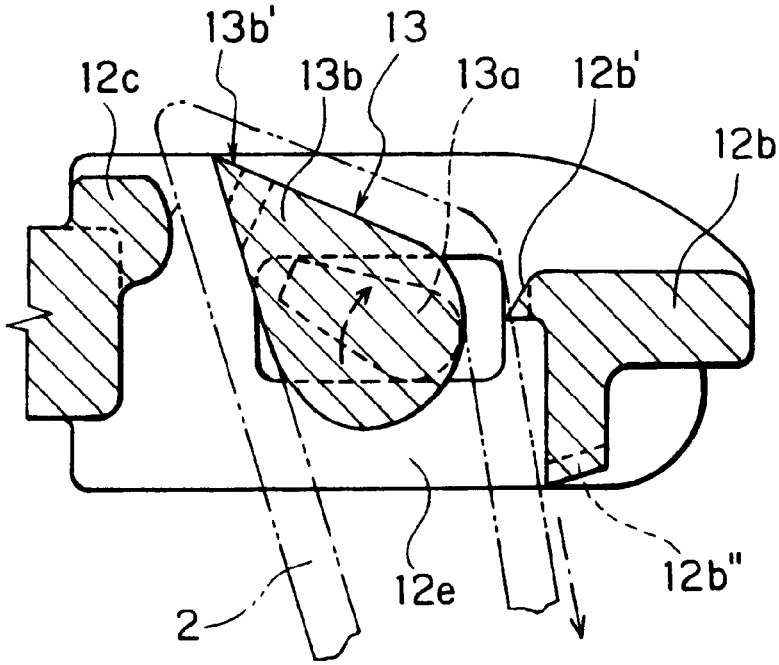
FIG. 5 is a cross sectional view which shows a function at a time of releasing the belt by the belt mounting structure in the buckle of FIG. 1.

The belt winding rod 13 is structured such that both end axial portions 13*a* thereof are loosely fitted and supported in the axial portion supporting holes 12*d* formed in the right and left side wall portions 12*e* of the mounting hole 12*a*. Both end axial portions 13*a* of the belt winding rod 13 have a cross-sectional configuration capable of reciprocating within the axial portion supporting holes 12*d* at a predetermined distance, and is formed so as to rotate at a predetermined angle at each of the axial portions. In this embodiment, as shown in FIG. 4, a cross-sectional configuration of the axial portion 13*a* is formed in a substantially isosceles triangle having a short bottom line and corner portions each formed in a circular arc shape, and it is set such that a size of the bottom line is shorter than a height of the axial portion supporting holes 12*d* and a height of an apex is shorter than a longitudinal length of the axial portion supporting holes 12*d*. Also, the corner formed by the equal sides of the isosceles triangle shaped axial portion 13*a* may be a flat side as shown in FIG. 5.

Further, a main body 13*b* of the belt winding rod 13 is structured such that a cross section thereof is formed in a waterdrop shape, and the axial portion 13*a* is inserted and supported in the axial portion supporting holes 12*d* in a loosely fitted state, with a tip portion 13*b*' of the main body being directed to the inner wall surface of the belt mounting hole 12*a* in the side that the insertion leg portion 14 extends. An uneven portion 13*b*' for eating into the belt 2 is formed in the tip portion 13*b*'. In a state that the axial portion 13*a* of the belt winding rod 13 is inserted to the axial portion supporting holes 12*d*, a whole of the plug is integrally formed by an injection molding provided with a core metal mold which is performed in conventional way.

The axial portions 13*a* are provided on the main body 13*b* as shown in FIG. 4 in a state that one of the oblique side portions of the axial portion 13*a* is positioned on a lower side portion 12*d*' of the axial portion supporting holes 12*d* in the belt mounting hole 12*a*, and when the belt 2 is wound around the main portion 13*b* of the belt winding rod 13 and is pulled substantially in parallel to the back surface of the buckle 1, the tip portion 13*b*' of the main body 13*b* of the belt winding rod 13 is faced to the lower surface of the bulging portion 12*c* in the belt mounting hole 12 so as to form a gap for holding the belt 2 therebetween, and also when pulling the belt 2 in an oblique direction at a predetermined angle with respect to the lower surface of the buckle 1, a gap for allowing upward rotation together with the belt 1 without interfering with the bulging portion 12*c* can be secured.

The socket 20 has a receiving space portion 24 in which an insertion port 24*a* for the plug 10 is formed, and portions to be engaged 26 (hereafter called "engaged portion") with the engaging portions 16 of the plug 10 are projected from an inner surface of the receiving space portion 24 in a mutually opposing manner. In the engaged portions 26, a pair of engaging holes 22 engaging with the protruding engaging surfaces 16*a* of the engaging portions 16 are formed on a surface of the receiving space portion 24. Further, a pair of opening portions 21 from which each of the operation portions 18 of the plug 10 outwardly exposes in a state that the first engaging portion 16 is engaged with the engaged portion 26 are formed in right and left side portions of the socket 20. A peripheral edge of the opening portion 21 is formed in a shape being gradually greatly constricted toward the tip end side in the insertion direction of the insertion leg portion 14.

Figure 2:
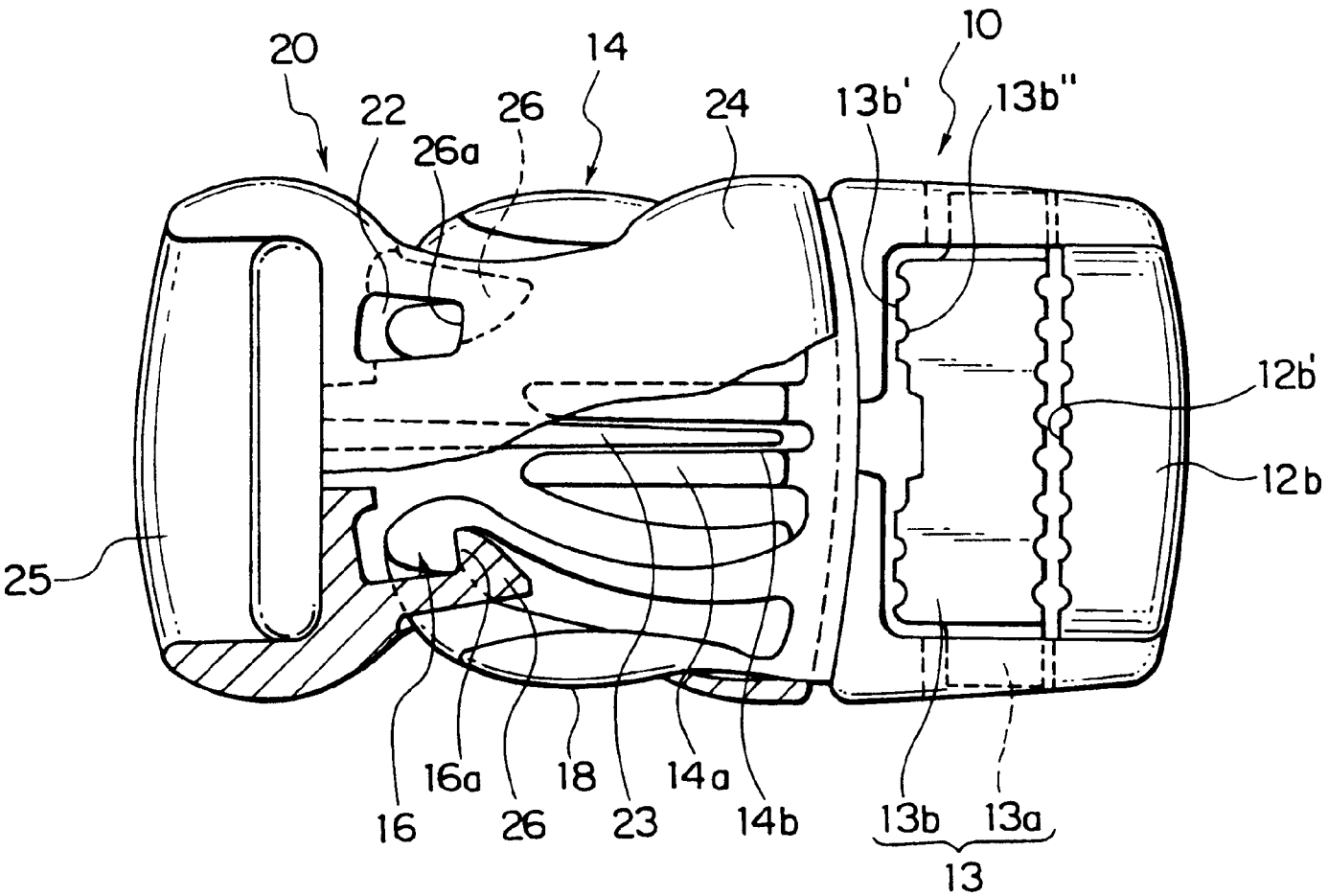
FIG. 2 is a plan view which shows the buckle of FIG. 1 in a connected state partly in cross section.
Figure 3:
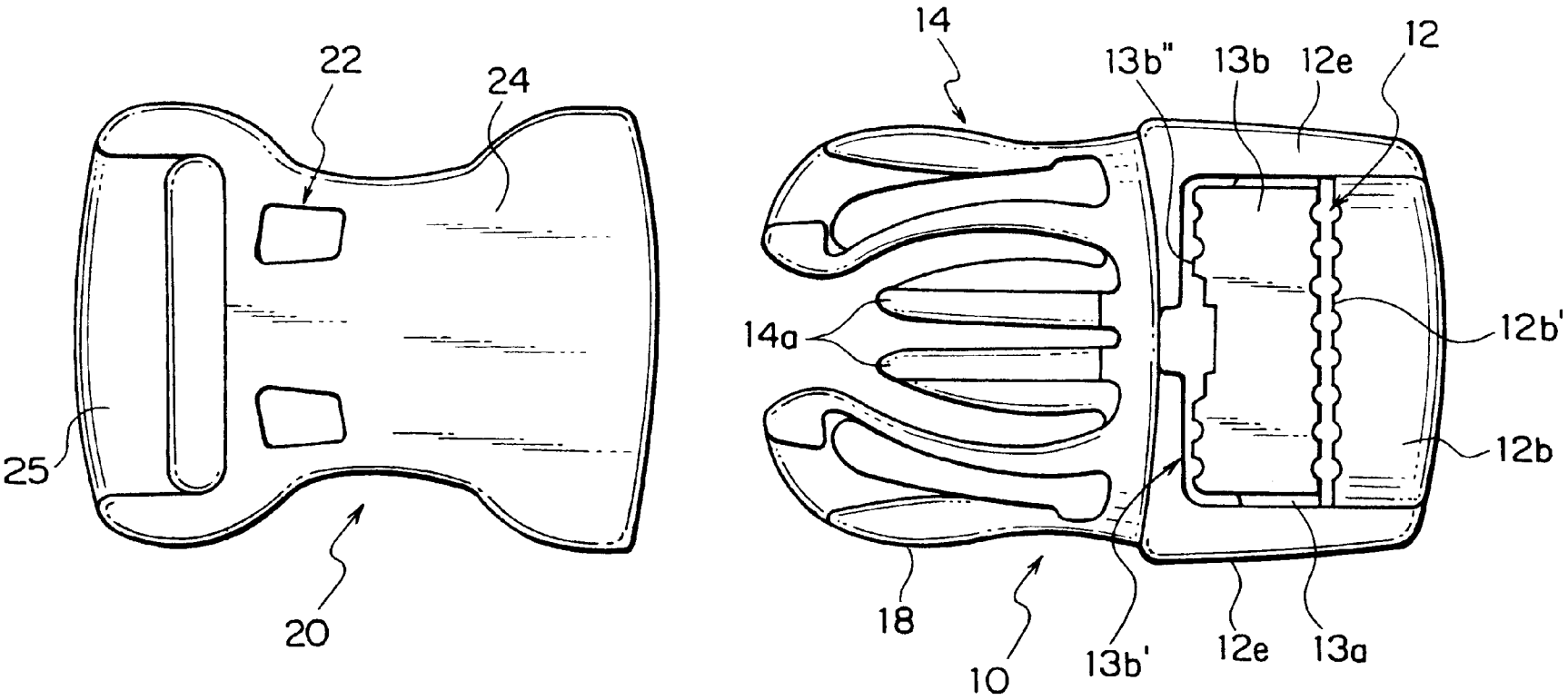
FIG. 3 is a plan view which shows a separated state of the buckle of FIG. 1.

A belt mounting portion 25 for inserting and fixing the belt and the like in the side of the socket is formed at an end portion in the side opposite to the insertion port 24*a* of the socket 20. Further, a guide piece 23 to be inserted to the groove portion 14*b* of the protruding piece 14*a* projected from between the insertion leg portions 14 of the plug 10 is provided in the center portion within the receiving space portion 24 so as to extend toward the insertion port 24*a*, as shown in FIG. 2. The guide piece 23 make an operation for inserting the plug 10 to the socket 20 easy, and prevents the plug 10 from swinging within the socket 20 after connection.

In the buckle provided with the structure mentioned above in accordance with this embodiment, in order to fix the belt 2 to the belt mounting portion 12 of the plug 10, at first, the end portion of the belt 2 is inserted to the belt insertion space in front (i.e. in the side of the insertion leg portion 14) of the belt mounting hole 12*a* separated by the belt winding rod 13 into two front and rear portions from the lower surface side of the plug, and is inserted to the rear belt insertion space while winding around the belt winding rod 13. In this case, when the belt 2 is pulled rearwardly substantially in parallel to the lower surface of the connection rod 12*b* formed at the rear end of the plug 10, a rotating force in a counterclockwise direction acts on the belt winding rod 13, so that an oblique surface of the axial portion 13*a* of the belt winding rod 13 is in a state of being closely attached to the axial portion supporting holes 12*d*.

Since the axial portion 13*a* of the belt winding rod 13 having the cross section formed in the isosceles triangle shape and the main body 13*b* of the belt winding rod having the cross section formed in the waterdrop shape are integrally formed in accordance with the relation mentioned above, in a state that the oblique surface of the axial portion 13*a* is closely attached to the axial portion supporting holes 12*d*, as shown in an imaginary line in FIG. 4, the tip portion 13*b*' of the main body 13*b* of the belt winding rod 13 pressure contacts the lower surface of the expanding portion 12*c* expanding from the upper end edge of the front wall surface in the belt mounting hole 12*a* via the belt 2, so that a fixation with no slackness of the belt 2 can be obtained. Further, since the uneven surface 13*b*" is formed in the tip portion 13*b*', it is structured such that the uneven surface 13*b*" eats into the belt 2. Still further, the belt end portion wound around the main body 13*b* of the belt winding rod 13 and being pulled out rearward from the rear belt insertion space between the main body 13*b* and the connection rod 12*b* is structured such that the uneven surface 12*b*' formed in the shoulder portion of the connection rod 12*b* and the uneven surface 12*b*" formed in the lower end of the lower protruding portion in the connection rod 12*b* strongly eat thereinto.

Accordingly, when the buckle is attached to a user and the belt 2 is pulled in a direction shown by an arrow in FIG. 4, the belt 2 wound around the belt winding rod 13 and tensioned in a direction parallel to the connecting direction of the buckle 1 is held between the belt winding rod 13 and the connection rod 12*b* while the uneven surface 13*b*" of the tip portion 13*b*' in the belt winding rod 13 and the uneven surface 12*b*' of the connection rod 12*b* strongly eat into the belt 2, and the lower end uneven surface 12*b*" of the connection rod 12*b* in the belt mounting hole 12*a* strongly eat thereinto, so that the belt 2 is not loosened.

Further, when it is intended to take out the belt 2 from the plug 10 or adjust an effective length thereof, the belt mounting hole 12 and the belt winding rod 13 are relatively rotated by inserting a finger under the lower surface of the connection rod 12*b* in the side opposite to the extending direction of the insertion leg portion 14 of the plug 10 and lifting up its rearward extending portion, and when pulling the belt 2 downward, the belt 2 is in a state shown in FIG. 5. That is, when the axial portion 13*a* of the belt winding rod 13 rotates in a clockwise direction within the axial portion supporting holes 12*d* of the belt mounting hole 12*a* as shown by an arrow in FIG. 5, the tip portion 13*b*' rotates upwardly after passing through the expanding portion 12*c* without interfering with the expanding portion 12*c* of the belt mounting hole 12*a*. Due to this rotation, since the nipping between the belt mounting hole 12*a* and the belt winding rod 13 is cancelled and the gap between them is increased, a friction force exerting on the belt 2 wound around the belt winding rod 13 is reduced, so that it is possible to smoothly move the belt 2 on the belt winding rod 13.

In accordance with the manner mentioned above, the belt 2 is mounted to the plug 10. And in order to connect the plug 10 to the socket 20, as shown in the drawing, the insertion leg portion 14 is inserted to the insertion port 24*a* of the receiving space portion 24. At this time, the outer side surfaces of the operation portions 18 are at first brought into contact with the inner tip end portions of the opening portions 21, and the insertion leg portions 14 are gradually curved inwardly. Then, the tip end portions of the insertion leg portions 14 are brought into contact with the engaged portions 26 within the receiving space portion 24 by further inserting the plug 10, and the engaged portions 26 are positioned at the recess grooves 11 of the insertion leg portions 14, so that the insertion leg portions 14 are elastically deformed inwardly in accordance with the insertion. Then, by further insertion, the engaged portions 26 move apart from the engaging portions 16, the elastically deformed insertion leg portions 14 are returned to their original positions, and the engaging surface 16*a* and a surface to be engaged 26*a* (hereafter called "engaged surface") are faced to each other, so that a connection between the plug 10 and the socket 20 is completed.

Further, when releasing the connection between the plug 10 and the socket 20, the engaging portions 16 and the engaged portions 26 are disengaged by pressing the operation portions 18 from the both sides, so that the plug 10 can be pulled out. At this time, since the opening portions 21 of the socket 20 is greatly constricted to a direction of the tip end of the plug 10, the tip end side of the operation portions 18 is necessarily pressed, so that an operation of engaging and releasing can be easily performed.

In accordance with the buckle of this embodiment, since the insertion leg portions 14 of the plug 10 are easily bent in an elastic manner by the elongated holes 17 and particularly the side edge portions 14*c* inside the insertion leg portions 14 are curved in an outwardly expanding shape, a compression force acts on the side edge portions 14*c* due to the force in the inside direction, and the side edge portions 14*c* are easily bent so as to absorb the force so that an operation of insertion and releasing engagement of the insertion leg portions 14 can be made easy, and it is hard to break against an external force. Further, when the force in the direction of moving the plug 10 and the socket 20 apart from each other is applied, a component force in a direction of engagement mutually directing outward acts on the tip end portions of the insertion leg portions 14 due to inclines of the engaging surfaces 16*a* and the engaged surfaces 26*a*.

Further, the side edge portions 14*c* of the curved insertion leg portions 14 push the engaging portions 16 to the outer side i.e. the engaging direction so as to become straight. The engaging portions 16 and the engaged portions 26 can obtain an engaging state having a significantly strong connection force due to the above. Particularly, since the first engaging portions 16 and the engaged portions 26 are at the tip end portions of the insertion leg portions 14, a resistance at a time of inserting and engaging and a force required for releasing the engagement may be small. Further, since the tip end side of the operation portions 18 are pressed when canceling the engagement due to the constriction of the opening portions 21, an operation of canceling the engagement can be significantly easily performed. Still further, since the insertion leg portions 14 are inserted so as to be gradually curved, a force required for inserting may be small, so that an insertion can be further easily performed.

FIGS. 6 to 10 show a second embodiment in which the present invention is applied to, for example, a human body restraining belt. That is, a buckle 101 in accordance with the second embodiment is buckle of the type in which a plug 110 is inserted to each of opposing side portions with respect to single socket 120 and another belt is fixed and mounted to another side portion to which the plug 110 is not inserted. In this case, the same reference numerals are used for substantially the same elements as those of the first embodiment mentioned above, and a particular description thereof is omitted.

The plug 110 has an insertion tongue piece 114 formed in a flat plate shape and extending from the belt mounting portion 12, and a pair of support pieces 117 extending along a slit 115 in both right and left side portions of the tongue 114. A pair of right and left engaging portions 116 formed by cutting a center portion and each having a downward inclined upper surface 116*a* are projected from a tip end edge of the tongue 114. Accordingly, the engaging portions 116 are formed in a wedge shape in an inserting direction. Further, bulging portions 114*a* smaller than the engaging portions 116 are formed in a center cut portion respectively. The bulging portions 114*a* are also formed in a wedge shape having an oblique surface inclining toward the tip end portion of the tongue 114.

Further, each of the support pieces 117 extending from the both sides of the insertion tongue 114 is structured such that an elongated hole 118 extending vertically is formed at a center portion, and a width in a direction perpendicular to the inserting direction of the support piece 117 is substantially equal to a width of a gap of an insertion portion 122 in the socket 120. Then, a pair of right and left triangular ribs 114*c* for reinforcement are formed in a boundary portion between a lower surface of a base end portion of the tongue 114 and the belt mounting portion 12.

Figure 8:
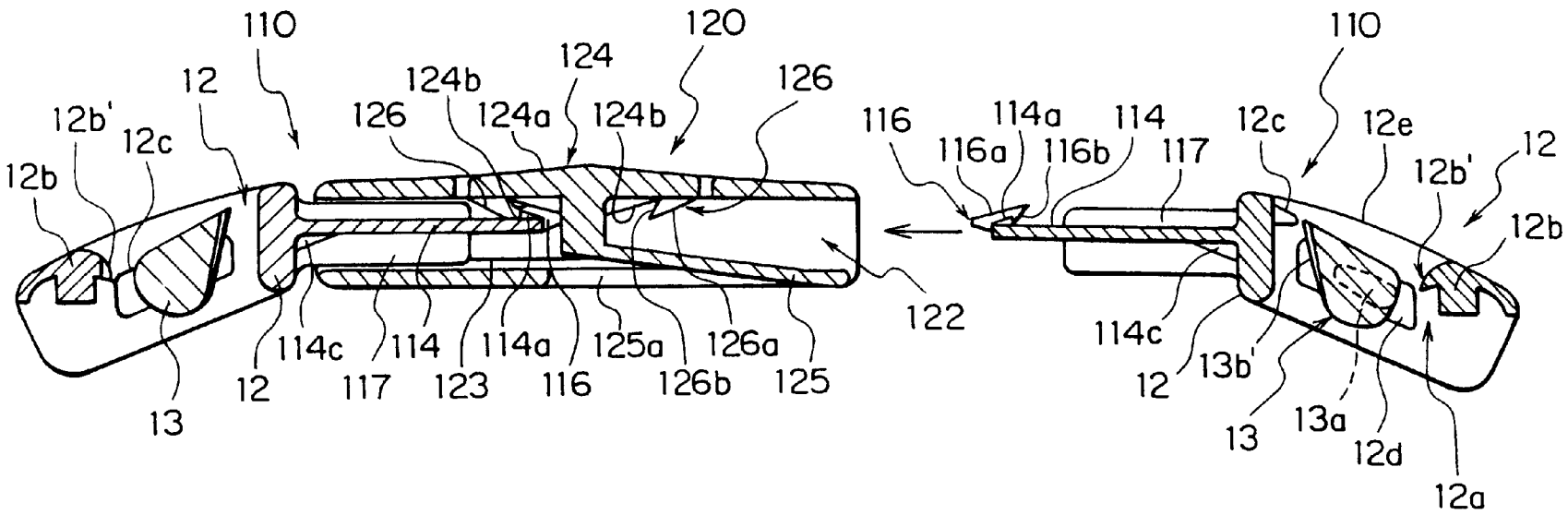
FIG. 8 is a vertical sectional view which shows an internal structure of the buckle of FIG. 6 at a time of connecting operation.

The belt mounting portion 12 in each of the plugs 110 is slightly inclined to a downward direction with respect to an extending direction of the insertion tongue 114, and is formed substantially in an inverted-V shape in side view of the whole plug. Accordingly, the belt mounting portion 12 is constituted by substantially the same belt mounting structure as that of the first embodiment. That is, the belt mounting portion 12 is constituted by a substantially rectangular frame body having the belt mounting hole 12*a* in a center, and the uneven surface 12*b*' for eating into the belt 2 is formed on the inner surface of the upper end edge of the connection rod 12*b* in the side opposite to the extending side of the insertion leg portion 114. The connection rod 12*b* is, as shown in FIG. 8, set to have a thickness of half a vertical thickness of the belt mounting portion 12, and is structured such that the rear end of the belt mounting portion 12 is easily lifted up by a finger. The bulging portion 12*c* along the upper end edge thereof is provided on the inner wall surface in the belt mounting hole 12*a* in the extending side of the insertion tongue 114. Further, the axial portion supporting holes 12*d* formed substantially in a horizontally longer parallelogram along the incline of the belt mounting portion 12 are formed through the substantially center portion of each of the right and left side wall portions 12*e* of the belt mounting hole 12*a*.

Figure 9:
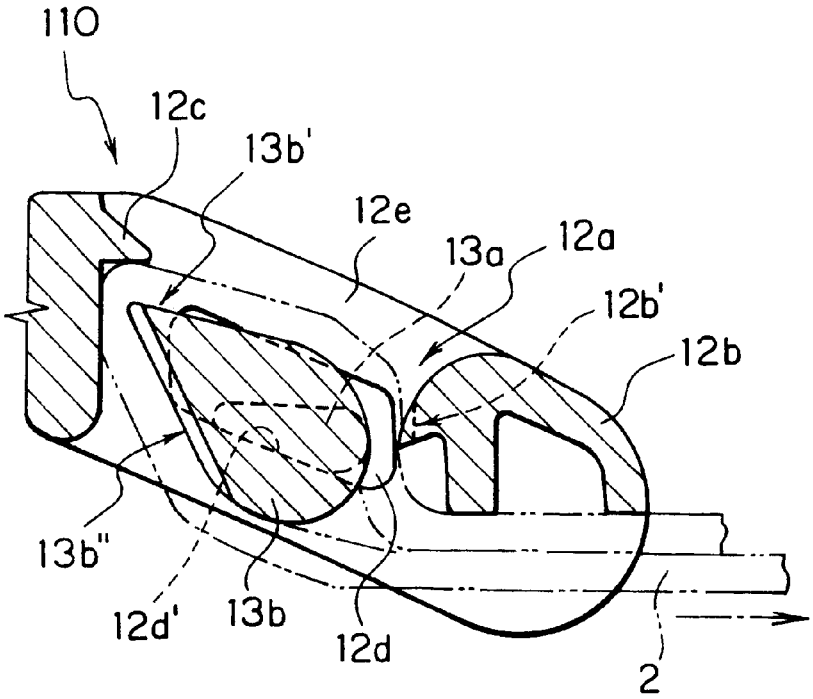
FIG. 9 is a cross sectional view which shows a function at a time of fixing the belt by the belt mounting structure in the buckle of FIG. 6.
Figure 10:
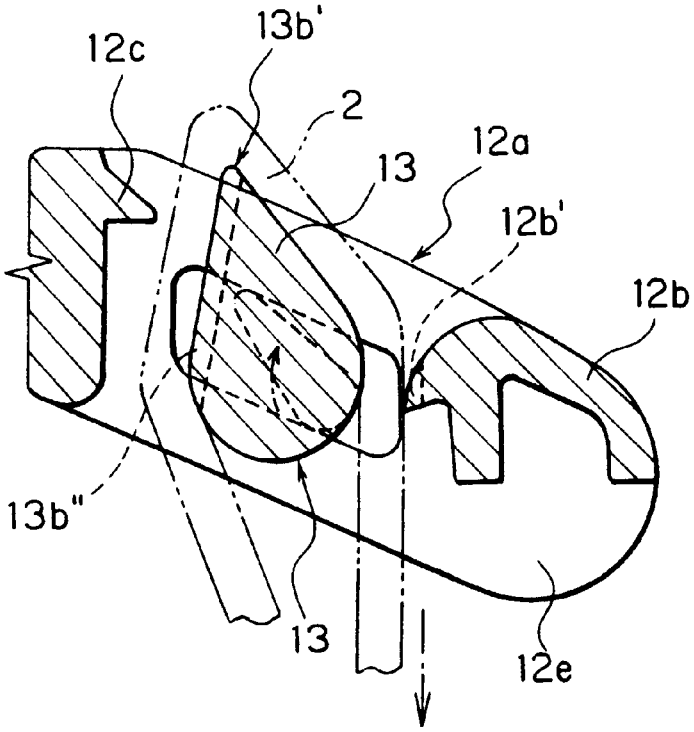
FIG. 10 is a cross sectional view which shows a function at a time of releasing the belt by the belt mounting structure in the buckle of FIG. 6.

The belt winding rod 13 is structured such that both end axial portions 13*a* thereof are loosely fitted and supported in the axial portion supporting holes 12*d* formed in the right and left side wall portions 12*e* of the mounting hole 12*a*. The both end axial portions 13*a* of the belt winding rod 13 have a cross-sectional configuration capable of reciprocating within the axial portion supporting holes 12*d* at a predetermined distance, and is formed so as to rotate at a predetermined angle at each of the axial portions. In this embodiment, as shown in FIG. 9, a cross-sectional configuration of the axial portion 13*a* is formed in a substantially isosceles triangle having a short bottom line and corner portions each formed in a circular arc shape, and it is set such that a size of the bottom line is shorter than a height (perpendicular to the longitudinal direction) of the axial portion supporting holes 12*d* and a height of an apex is shorter than a longitudinal length of the axial portion supporting holes 12*d*. Also, the corner formed by the equal sides of the isosceles triangle shaped axial portion 13*a* may be rounded as shown in FIG. 9.

Further, the main body 13*b* of the belt winding rod 13 is structured such that a cross section thereof is formed in a waterdrop shape, and the axial portion 13*a* is inserted and supported in the axial portion supporting holes 12*d* in a loosely fitted state, with a tip portion 13*b*' of the main body being directed to the inner wall surface of the belt mounting hole 12*a* in the side that the insertion leg portion 14 extends. An uneven portion 13*b*" for eating into the belt 2 is formed in the tip portion 13*b*'. Accordingly, the mounting manner between the belt mounting hole 12*a* and the belt winding rod 13 is substantially the same as that of the first embodiment mentioned above.

The axial portions 13*a* are provided on the main body 13*b* as shown in FIG. 9 in a state that one of the oblique side portions of the axial portion 13*a* is positioned on the lower side portion 12*d*' of the supporting holes 12*d* in the belt mounting hole 12*a* in a closely attached manner, and when the belt 2 wound around the main portion 13*b* of the belt winding rod 13 and is pulled substantially in parallel to the back surface of the buckle 1, the tip portion 13*b*' of the main body 13*b* of the belt winding rod 13 is faced to the lower surface of the bulging portion 12*c* in the belt mounting hole 12*a* so as to form a gap for holding the belt 2 therebetween, and also when downwardly pulling the belt 2 in an oblique direction at a predetermined angle with respect to the lower surface of the buckle 1, a gap for allowing upward rotation and passing together with the belt 1 without interfering with the bulging portion 12*c* can be secured.

Figure 6:
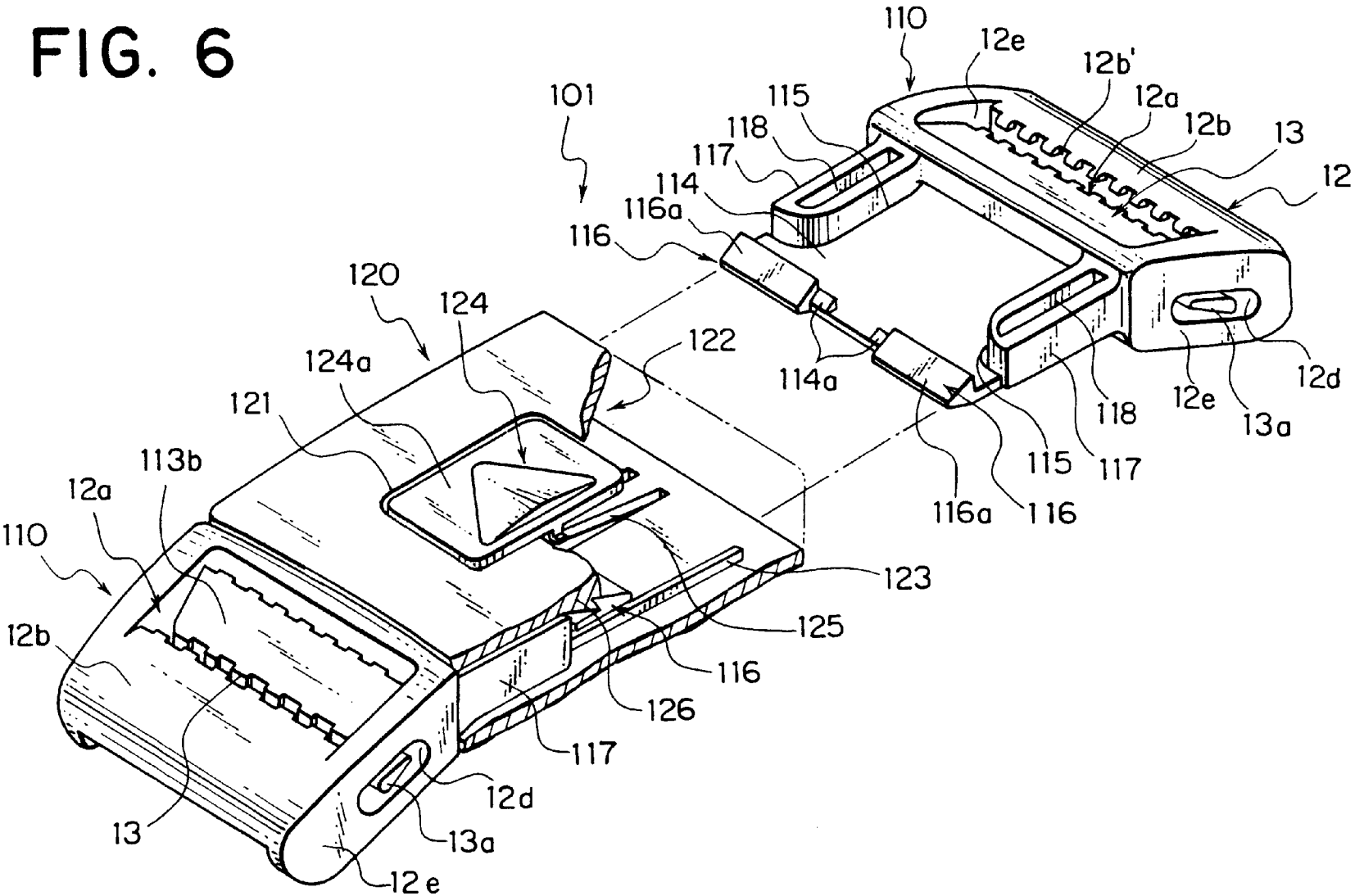
FIG. 6 is a perspective view which shows a separation state of a buckle comprising single socket and a pair of plugs provided with a belt mounting structure in accordance with a second embodiment of the present invention.

On the contrary, the socket 120 is formed in a flat and hollow cylindrical shape as shown in FIG. 6, the hollow portion becomes the insertion portion 122 of each of the plugs 110, and a guide projection 123 for guiding the plug 110 is formed on an inner wall surface of a lower wall thereof in an inserting direction of the insertion tongue 114. An operation portion 124 is provided in a center portion of the socket 120, and the operation portion 124 is positioned within an operation hole 121 formed on a wall surface in the side of a front surface of the socket 120 and has an operation piece 124*a* exposing outward and two pairs of pressing portions 124*b* integrally formed in a lower surface of the operation piece 124*a* and pushing down each of the insertion tongues 114 of the plug 110. Pairs of pressing portions 124*b* are disposed in front and rear portions so as to be brought into contact with the bulging portions 114*a* in the insertion tongues 114, and a contact surface of the pressing portion 124*b* is formed in an oblique surface corresponding to the oblique surface of the bulging portion 114*a* formed in the center portion of the tip end of the insertion tongue 114.

Further, an elastic portion 125 is bent and extended from the operation piece 124*a* through the lower surface side of the socket to the insertion port of the insertion portion 122. A through hole 125*a* is formed on the lower surface of the socket 120 in which the elastic portion 125 extends so that the elastic portion 125 can swing inside and outside the socket.

Two pairs of portions to be engaged 126 (hereafter called "engaged portion") which engage with the engaging portion 116 of each of the plugs 110 are projected from the inner peripheral surface of the front surface wall portion of the socket 120. The engaged portions 126 are integrally projected from the lower surface of the operation piece 124*a* of the socket 120 and are arranged at a shifted position so as not to overlap with each other in the insertion direction of the plug 110 in the insertion portion 122. Further, an oblique surface 126*a* inclined to the insertion direction is formed in the engaged portion 126 so as to be complementary with the shape of the upper surface 116*a* of the engaging portion 116. Still further, an surface to be engaged 126*b* (hereafter called "engaged surface") slightly inclined to the insertion direction of the plug 110 from the surface perpendicular to the insertion direction is formed so as to be complementary with the shape of the engaging surface 116*b* of the engaging portion 116.

Figure 7:
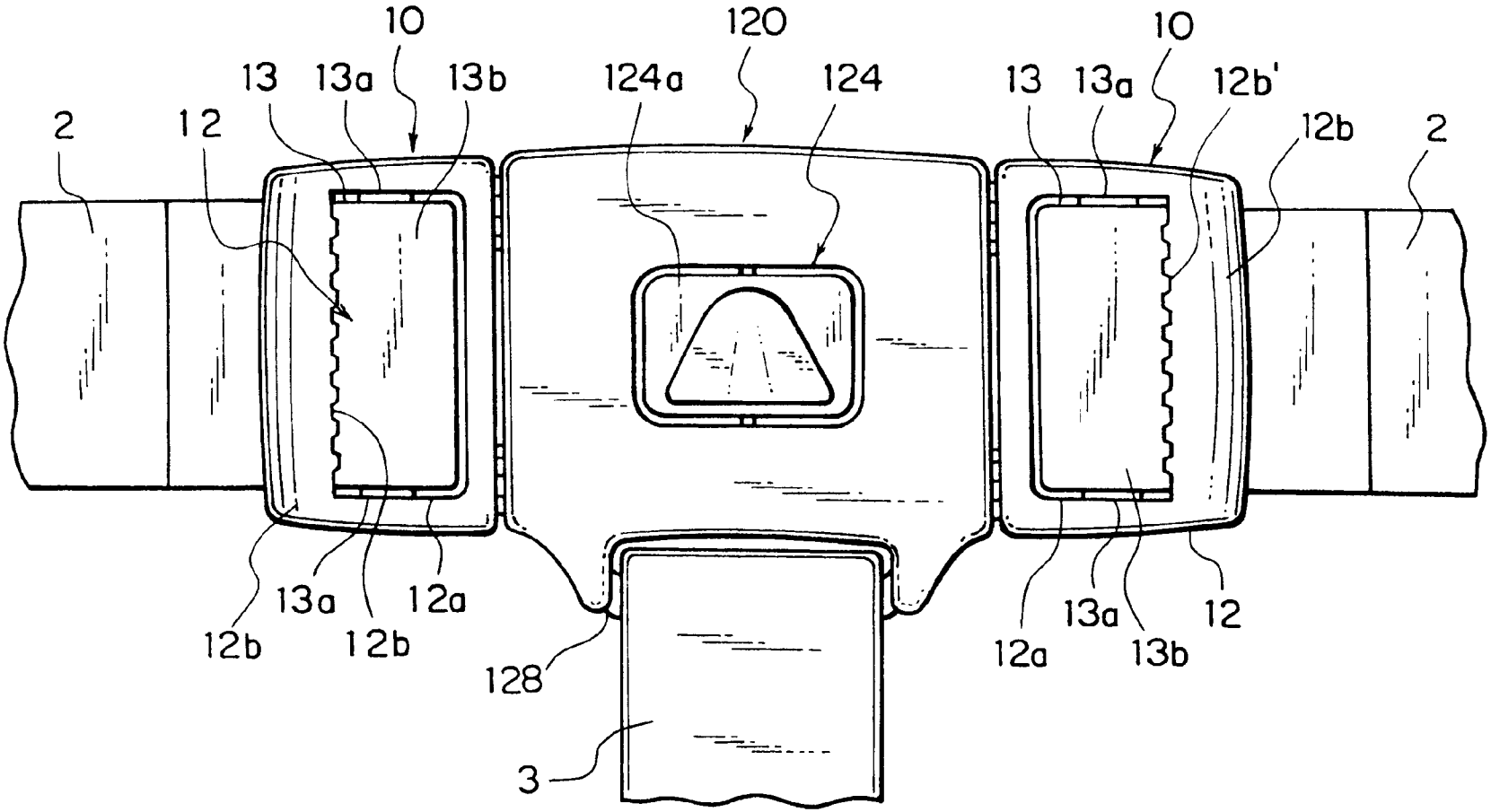
FIG. 7 is a plan view of the buckle of FIG. 6 in a connected state.

Further, a belt mounting portion 128 for mounting the other belt 3 is formed in a side surface of the socket 120 in a direction perpendicular to the plug insertion direction in the insertion portion 122 as shown in FIG. 7. With respect to a method of producing the buckle having the structure mentioned above, the buckle can be produced by the same method as the one disclosed in Japanese Patent Laid-Open Publication No. 8-140712.

In the buckle 101 in accordance with the second embodiment, in order to mount the plug 110 to the socket 120, the insertion tongue piece 114 is inserted to the insertion port of the insertion portion 122. At this time, the engaging portion 116 of the insertion tongue 114 moves forward while being brought into contact with the engaged portion 126 of the socket 120, the upper surfaces 116*a* of the engaging portion 116 are pressed down along the oblique surfaces 126*a* of the engaged portions 126, and finally the engaging portions 116 ride over the engaged portions 126, so that the engaging surfaces 116*b* and the engaged surfaces 126*b* are engaged with each other. Since this engagement is performed in accordance that the engaging portion 116 elastically deforms temporarily with respect to the engaged portion 126, each of a pair of front and rear plugs 110 can be independently and surely engaged.

Further, in order to release the connection, when the operation piece 124*a* of the operation portion 124 is pressed, the pressing portion 124*b* presses the bulging portion 114*a* of the insertion tongue, so that the tongue 114 elastically deforms to the lower surface side. At this time, the oblique surface of the pressing portion 124*b* and the oblique surfaces of the bulging portions 114*a* are elastically pressure contacted, thus the plug 110 is urged to a direction of ejecting out from the insertion portion 122 due to the elastic force and the direction of the oblique surface. Therefore, the engagement between the engaging portion 116 and the engaged portion 126 is canceled, and the plug 110 is pressed out from the socket 120. Then, the pressing portion 124*b* presses the bulging portions 114*a* in each of a pair of opposing tongue 114, and the engagement of the pair of plugs 10 is simultaneously released by pressing the operation piece 124*a* so as to be pressed out.

Further, in order to fix the belt 2 to the belt mounting portion 112 of each of the pair of plugs 110, the end portion of the belt 2 is inserted to the belt insertion space in front of (i.e. in the side of the insertion tongue 114 of) the belt mounting hole 12*a* separated into two portions by the belt winding rod 13 from the lower surface side of the plug 110, and is wound around the belt winding rod 13 so as to insert to the rear belt insertion space. In this case, when the belt 2 is pulled rearwardly in parallel to the lower surface of the connection rod 12*b* formed in the rear end of the plug 110, a rotational force in a counterclockwise direction acts on the belt winding rod 13, so that oblique surfaces of the axial portions 13*a* of the belt winding rod 13 are in a state of being closely attached to the axial portion supporting holes 12*d*.

Since the axial portion 13*a* of the belt winding rod 13 having the cross section of an isosceles equilateral triangle shape and the main body 13*b* of the belt winding rod 13 having the cross section formed in a waterdrop shape are integrally formed in accordance with the relation mentioned above, in a state that the oblique surfaces of the axial portions 13*a* are closely attached to the axial portion supporting holes 12*d*, as shown in an imaginary line in FIG. 9, the tip portion 13*b*' of the main body 13*b* of the belt winding rod 13 pressure contacts the lower surface of the expanding portion 12*c* expanding from the upper end edge of the front wall surface in the belt mounting hole 12*a* via the belt 2, so that a fixation with no slackness of the belt 2 can be obtained. Further, since the uneven surface 13*b*" is formed in the tip portion 13*b*', it is structured such that the uneven surface 13*b*" strongly eats into the belt 2. The belt end portion wound around the main body 13*b* of the belt winding rod 13 and being pulled out rearward from the rear belt insertion space between the main body 13*b* of the belt winding rod 13 and the connection rod 12*b* is firmly held between the rear end edges of the belt winding rod 13 and the connection rod 12 since the uneven surface 12*b*' formed in the upper edge of the inner wall surface of the connection rod 12*b* strongly eat into the belt end portion.

Accordingly, when the buckle is attached to a user and the belt 2 is pulled in a direction shown by an arrow in FIG. 9, the belt 2 wound around the belt winding rod 13 and tensioned in a direction parallel to the connecting direction of the buckle 1 is held between the belt winding rod 13 and the connection portion 12*b* while the uneven surface 13*b*" of the tip portion 13*b*' in the belt winding rod 13 and the uneven surface 12*b*' of the connection portion 12*b* strongly eat into the belt 2, so that the belt 2 is not loosened. At this time, in accordance with this embodiment, since the shape of the side surface of the plug 110 is particularly formed by providing the belt mounting portion 12 and the insertion tongue 114 in an inverted-V shape, an angle between the mounted belt and the belt pulling direction becomes great as shown in FIG. 9 at a time of using the buckle 1, so that the uneven surfaces 12*b*', 13*b*" eat into the belt 2 more strongly than that of the first embodiment mentioned above so as to completely restrict the movement of the belt 2.

Further, when it is intended to take out the belt 2 from the plug 110 or adjust an effective length thereof, a finger is inserted to the lower surface side of the connection rod 12*b* on the side opposite to the extending direction of the insertion tongue 114 of the plug 110 and the rearward extending portion is lifted up. As a result, the belt mounting hole 12*a* and the belt winding rod 13 are rotated oppositely, and when pulling the belt downward, the belt 2 is in a state shown in FIG. 10. That is, when the axial portions 13*a* of the belt winding rod 13 rotate in a clockwise direction within the axial portion supporting holes 12*d* of the belt mounting hole 12*a* as shown by an arrow in FIG. 10, the tip portion 13*b*' rotates upwardly after passing through the expanding portion 12*c* without interfering with the expanding portion 12*c* of the belt mounting hole 12*a*. Due to this rotation, since the nipping between the belt mounting hole 12*a* and the belt winding rod 13 is cancelled and the gap between them is increased, a friction force exerting on the belt 2 wound around the belt winding rod 13 is reduced, so that it is possible to smoothly move the belt 2 on the belt winding rod 13.

The above description presents only typical embodiments of the present invention, and the present invention is not limited to the embodiments mentioned above and can be applied to various kinds of buckles of the type described, and various modifications are possible within the scope of the present invention.

What is claimed is:

1. A belt mounting structure of a buckle for use with a belt, comprising:

a plug and a socket, and belt mounting portions provided in respective base portions of the plug and the socket, at least one of the belt mounting portions having a belt winding rod having a main body and opposite end axial portions, the belt winding rod reciprocatable in a belt fastening direction within a belt mounting hole and rotatable at a predetermined angular range, supporting holes on right and left side wall surfaces of the at least one of the belt mounting portions, the belt winding rod supported by the axial portions being loosely supported in the supporting holes, the main body having a cross-sectional shape substantially in a waterdrop shape, and each axial portion having a cross-sectional shape substantially in a shape of an isosceles triangle, a bulging portion formed along an upper end edge of the belt mounting hole on a side in which the plug and socket are connected, and wherein when an oblique side portion of each axial portion is placed and supported on a long side portion of the respective supporting hole, a tip portion of the main body is pressured against a lower surface of the bulging portion with the belt when in use, and when the axial portions rotate within the supporting holes toward an upper side of the buckle, the tip portion of the main body rotates toward the upper side over the bulging portion avoiding an interference with the bulging portion.

2. A belt mounting structure according to claim 1, wherein an uneven surface for eating into the belt is formed along an upper end edge of a connection rod positioned on a side opposite to the side in which the plug and socket are connected, and an uneven surface is formed at least in the tip portion of the main body of the belt winding rod.

3. A belt mounting structure according to claim 2, wherein the connection rod of the belt mounting portion has a substantially inverted-L-shaped cross-sectional configuration.

4. A belt mounting structure according to any one of claims 1 to 3, wherein the belt mounting hole is formed in the belt mounting portion of the plug.

5. A belt mounting structure according to any one of claims 1 to 3, wherein the belt mounting hole is formed in the belt mounting portion of the socket.

6. A belt mounting structure according to any one of claims 1 to 3, wherein the buckle has a single socket and a single plug.

7. A belt mounting structure according to any one of claims 1 to 3, wherein the buckle has a single socket and two plugs.

8. A belt mounting structure according to claim 1, wherein the isosceles triangle shaped axial portion has a flat side at the apex.

9. A belt mounting structure according to claim 8, wherein the isosceles triangle shaped axial portion has a rounded side opposite the flat side.

10. A belt mounting structure according to claim 1, wherein the isosceles triangle shaped axial portion has a rounded side at the apex.

* * * * *

UNITED STATES PATENT AND TRADEMARK OFFICE

CERTIFICATE OF CORRECTION

PATENT NO. : 6,148,486 
DATED : November 21, 2000
INVENTOR(S) : Ryoichiro Uehara and Yoshinobu Takahashi It is certified that error appears in the above-identified patent and that said Letters Patent is hereby corrected as shown below:

Title page,
Item [76], delete in its entirety and substitute therefore:

-- [75] Inventors: Ryoichiro Uehara; Yoshinobu Takahashi, both of Toyama, Japan

[73] Assignee: YKK Corporation, Tokyo, Japan --.

Signed and Sealed this

Tenth Day of September, 2002

*Attest:*

*Attesting Officer*

JAMES E. ROGAN
*Director of the United States Patent and Trademark Office*